US008842056B2

(12) United States Patent
Batchelor et al.

(10) Patent No.: US 8,842,056 B2
(45) Date of Patent: Sep. 23, 2014

(54) TUNEABLE FREQUENCY SELECTIVE SURFACE

(75) Inventors: John Batchelor, Kent (GB); Benito Sanz-Izquierdo, Kent (GB); Edward Parker, Kent (GB); Jean-Baptiste Robertson, Kent (GB)

(73) Assignee: University of Kent (GB)

( * ) Notice: Subject to any disclaimer, the term of this patent is extended or adjusted under 35 U.S.C. 154(b) by 510 days.

(21) Appl. No.: 13/147,832

(22) PCT Filed: Feb. 11, 2010

(86) PCT No.: PCT/GB2010/050220

§ 371 (c)(1),
(2), (4) Date: Nov. 23, 2011

(87) PCT Pub. No.: WO2010/092390

PCT Pub. Date: Aug. 19, 2010

(65) Prior Publication Data

US 2012/0098628 A1 Apr. 26, 2012

(30) Foreign Application Priority Data

Feb. 13, 2009 (GB) ..... 0902389.6

(51) Int. Cl.
*H01Q 15/02* (2006.01)
*H01Q 15/00* (2006.01)

(52) U.S. Cl.
CPC ..... *H01Q 15/0066* (2013.01)
USPC ..... 343/909

(58) Field of Classification Search
USPC ..... 343/909, 700 MS, 705, 745, 787, 853
See application file for complete search history.

(56) References Cited

U.S. PATENT DOCUMENTS 5,140,338 A 8/1992 Schmier
5,463,404 A * 10/1995 Wall ..... 343/700 MS
5,767,789 A 6/1998 Afzali-Ardakani (Continued)

FOREIGN PATENT DOCUMENTS

EP 1566859 A2 8/2005
KR 2002/0027225 A1 4/2002

(Continued)

OTHER PUBLICATIONS

International Search Report and Written Opinion in PCT/GB2010/050220, mailed May 27, 2010.

(Continued)

*Primary Examiner* — Seung Lee
(74) *Attorney, Agent, or Firm* — Barnes & Thornburg LLP

(57) ABSTRACT

An electronically tuneable surface. The surface comprises: a conductive sheet comprising at least one opening; and a biasing circuit. The biasing circuit comprises first and second conductors, separated from the conductive sheet by a dielectric, and arranged at mutually opposing sides of the opening such that each conductor is capacitively coupled to the conductive sheet at the respective side of the opening. The conductors define a gap between them corresponding to the opening. The biasing circuit also comprises an electrical control element bridging the gap, connected to the first and second conductors. When the element is in a first state, the surface exhibits a first frequency transmission characteristic with respect to incident electromagnetic radiation, and when the element is in a second state, the surface exhibits a second, different characteristic.

15 Claims, 11 Drawing Sheets

(56) References Cited

U.S. PATENT DOCUMENTS

| | | | | |
|---|---|---|---|---|
| 6,232,931 | B1 | 5/2001 | Hart | |
| 6,525,695 | B2 | 2/2003 | McKinzie | |
| 6,917,343 | B2 | 7/2005 | Sanchez | |
| 6,952,190 | B2 | 10/2005 | Lynch | |
| 7,151,506 | B2 | 12/2006 | Knowles | |
| 7,173,565 | B2 | 2/2007 | Sievenpiper | |
| 7,190,315 | B2 * | 3/2007 | Waltho | 343/705 |
| 7,253,780 | B2 * | 8/2007 | Sievenpiper | 343/745 |
| 7,903,040 | B2 * | 3/2011 | Gevorgian et al. | 343/787 |
| 2002/0057222 | A1 | 5/2002 | McKinzie | |
| 2002/0167457 | A1 | 11/2002 | McKinzie | |
| 2003/0052757 | A1 | 3/2003 | McKinzie | |
| 2003/0112186 | A1 | 6/2003 | Sanchez | |
| 2003/0142036 | A1 | 7/2003 | Wilhelm | |
| 2004/0206527 | A1 | 10/2004 | Yokota | |
| 2004/0227682 | A1 | 11/2004 | Anderson | |
| 2006/0044211 | A1 | 3/2006 | Ramprasad | |

FOREIGN PATENT DOCUMENTS

| | | | |
|---|---|---|---|
| WO | WO-98/26471 | A2 | 6/1998 |
| WO | WO-01/97328 | A1 | 12/2001 |
| WO | WO-02/31914 | A1 | 4/2002 |
| WO | WO-02/089256 | A1 | 11/2002 |
| WO | WO-03/047030 | A1 | 6/2003 |
| WO | WO-03/063292 | A1 | 7/2003 |
| WO | WO-2004/093244 | A2 | 10/2004 |
| WO | WO-2007/123504 | A1 | 11/2007 |
| WO | WO-2008/079442 | A2 | 7/2008 |
| WO | WO-2008/140543 | A1 | 11/2008 |

OTHER PUBLICATIONS

Search Report in GB 0902389.6, dated Apr. 9, 2009.

Kiani, "Single-Layer Bandpass Active Frequency Selective Surface", Microwave and Optical Tech. Ltrs., vol. 50, No. 8, Aug. 2008, pp. 2149-2151.

Chang, "Active Frequency Selective Surfaces Using Incorporated PIN Diodes", IEICE Trans. Electron; vol. E91-C, No. 12, Dec. 2008, pp. 1917-1922.

Mitchell, "Research to Demonstrate the Ability of Close-Coupled Frequency . . . ", BAE Systems, 2004, Reference JS15235,Mar. 31, 2004, 84 pages.

Kiani, "Walls that can be tuned", DAWN Science, Jul. 2, 2005, 5 pages.

Ward, "Large Scale Tuneable FSS", Culham Electromagnetics and Lightening, CUL/EM/030258/RP/07, Mar. 2004, 20 pages.

Kiani, "Active Frequency Selective Surface Design for WLAN", 10th Australian Symposium on antennas, Feb. 14-15, 2007, i page.

Parker, "Application of FSS Structures to Selectively Control the Propogation . . . ", ERA Technology, Mar. 2004, 28 pages.

Chekroun, "Radant: New Method of Electronic Scanning", Microwave Journal, Feb. 1981, pp. 45-53.

* cited by examiner

TUNEABLE FREQUENCY SELECTIVE SURFACE

This invention relates to frequency-selective surfaces. In particular, it relates to active frequency selective surfaces, whose electromagnetic frequency transmission characteristics can be varied electronically.

Frequency dependent communication between two antennae can be realised by inserting a patterned conductive shield between the antennae. A pattern comprising conductive portions with intermittent apertures or gaps can be designed such that the shield resonates at a predetermined frequency or range of frequencies. Such a shield is known as a Frequency-Selective Surface (FSS). The FSS is transparent to frequencies in the desired range, but opaque to electromagnetic (EM) waves at other frequencies. That is, at frequencies in the desired pass-band, EM energy penetrates the shield, while out-of-band energy is reflected. Similarly, a shield may also be designed with inverse properties: that is, to stop frequencies in a particular undesired stop-band, but transmit other frequencies. Thus, a FSS can function as a band-pass or a notch filter, depending on the design of the conductive pattern.

Frequency Selective Surfaces have traditionally been employed in applications such as the radomes of antennae, dichroic reflectors, or reflection array lenses. They have also been applied to alter Radar Cross Sections (RCS), in stealth technologies, in Artificial Magnetic Conductors (AMC), and for Electromagnetic Interference (EMI) Protection.

It is also known to provide active frequency selective surfaces using PIN diodes. The basic principle is that the active elements enable selective interconnection and disconnection of the various parts of the conductive pattern, thereby changing the effective pattern presented to an incident EM wave and, accordingly, changing the frequency transmission characteristics of the surface.

In WO 2007/123504 A1 (Sievenpiper), for example, tuning of frequency selective surfaces using biasing configurations with PIN diodes was proposed. Sievenpiper highlights the difficulty of applying DC biasing in Jerusalem crosses and proposes the use of parallel LC circuits with diodes as an alternative to create a tuneable band-pass FSS. The designs require connections between arrays of conductors connected with PIN diodes at both sides of a circuit board. A range of configurations of the arrays of conductors at both sides of the circuit board, the PIN diodes and the via-connections is described.

According to a first aspect of the invention there is provided an electronically tuneable surface, comprising: a conductive sheet comprising at least one opening; and a biasing circuit comprising: first and second conductors, separated from the conductive sheet by a dielectric, and arranged at mutually opposing sides of the opening such that each conductor is capacitively coupled to the conductive sheet at the respective side of the opening, the conductors defining a gap between them corresponding to the opening; and an electrical control element bridging the gap, connected to the first and second conductors, wherein when the element is in a first state, the surface exhibits a first frequency transmission characteristic with respect to incident electromagnetic radiation, and when the element is in a second state, the surface exhibits a second, different characteristic.

This FSS uses an aperture or opening in a contiguous conductive sheet to provide frequency selectivity. Control of the frequency selection is provided by a biasing circuit disposed a small distance from the conductive sheet and separated from it by means of a dielectric layer. Here, "small" means that the thickness of the dielectric layer is relatively small compared with the wavelength of the pass-band (or stop-band) of interest—for example, preferably approximately 0.2% of this wavelength. The biasing circuit includes conductors which are positioned to correspond with parts of the conductive sheet at either side of the opening. These conductors and the corresponding parts of the conductive sheet on the opposite side of the dielectric have a mutual capacitive coupling. This coupling means that it may no longer be necessary to provide electrical connections between the active elements of the biasing circuit and the patterned conductive sheet. This can enable an active FSS to be fabricated more simply—for example, without the need for through-holes or vias in the dielectric. A variety of patterns can be used for the openings. A simple opening may have a single closed contour. Others may have multiple closed contours (for example, in the case of a loop-shaped opening). By using a pattern which comprises an opening in a contiguous conductive sheet, constraints in the layout of the biasing circuit can be relaxed, compared with patterns comprising isolated patches with open gaps. Away from the opening, the conductive sheet provides a shield which prevents conductors in the biasing circuit from influencing the frequency transmission properties of the overall surface. This can result both in greater design freedom and in improved flexibility in the control of the active electrical control elements. The conductors providing the capacitive coupling can also be arranged in a variety of patterns. For example, the conductors may be crenulated or convoluted. The conductive sheet may be a metallic sheet or layer. The first and second conductors may be metallic patches. The electrical control element may have the characteristics of, for example, a switch. This element bridges the gap between the first and second conductors and—because these conductors are capacitively coupled to the conductive sheet—can be considered to effectively bridge the opening itself. The frequency transmission characteristics of the surface can therefore be altered by changing the state of the control element.

The first and second conductors can be electrically isolated from the conductive sheet.

Electrical isolation eliminates the need for through-holes or vias to form electrical connections to the conductive sheet (or parts thereof). This can lead to simplified fabrication.

The state of the electrical control element is preferably controlled by a bias voltage applied between the first and second conductors.

This means that additional control lines (such as to control transistors, for example) need not be provided. Diodes of various types are suitable for use in embodiments of this kind, among various other alternatives. The diode is connected between the first and second conductors and biased by the voltages applied to those conductors.

The biasing circuit may comprise a plurality of electrical control elements bridging the gap, distributed along a length of the opening.

The frequency transmission characteristics of the surface are dependent on the effective dimensions (for example, length) of the opening. By placing switching elements at intervals along such a length, a greater shift in resonant frequency can be achieved, since the effective length of the opening is changed by a greater amount when the elements are switched between states (for example, on/off).

The elements among the plurality of elements may be independently controllable, so as to provide more than two states, each having a different frequency transmission characteristic.

This configuration allows the frequency characteristic to be adjusted more precisely. Different switching elements can be operated in different states to provide finer-grained control over the resonant frequency. For example, the resonant frequency of the opening can be shifted in incremental steps by turning on successive diodes bridging the opening. This offers the possibility of increased resolution in the adaptation of the frequency characteristics.

The opening may comprise an elongate portion in an orientation corresponding to a predetermined electromagnetic polarisation.

An elongate portion, such as a slot, having a dominant orientation, will be selectively with respect to EM polarisation in that orientation. That is, the slot will convey energy for waves having the corresponding polarisation but block (reflect) energy for waves having different polarisation. This enables selective control of at least one polarisation.

The opening may comprise elongate portions in at least two linearly independent orientations, corresponding to predetermined different electromagnetic polarisations.

Openings of this kind include (but are not limited to) shapes such as a cross; tripole; square loop; circular loop; or triangular loop. It may also include certain designs of convoluted slots. Such a pattern can enable one polarisation to be controlled selectively (by means of an active electrical control element bridging the corresponding elongate portion), while at least one other polarisation can pass through the surface.

The portions of the gap corresponding to the at least two elongate portions of the opening may each be bridged by a different electrical control element, each of which is independently controllable.

Providing both of the differently-oriented elongate portions with control elements enables fully independent control of the two polarisations.

The conductive sheet may comprise a plurality of openings with associated biasing circuits.

Such patterns can provide a number of potential advantages. By repeating the single opening pattern over a larger area, the influence of the surface on different types of EM waves is modified. In particular, a single slot may be appropriate when the transmitting (or receiving) antenna is positioned close to the surface; whereas multiple openings may be appropriate for antennae located at greater distances from the surface. Alternatively, multiple openings could be provided in a range of different dominant orientations. This provides a further means to control different polarisations independently.

Electrical control elements of the biasing circuits for the plurality of openings may be independently controllable.

This biasing arrangement allows more flexible control of the frequency transmission characteristics. This could be exploited in a variety of ways. For a plurality of openings with different orientations, such biasing offers independent control of polarisations. Alternatively, localised control of the openings can be implemented—for example, in a surface which encloses an antenna, columns of openings might be controlled independently to provide directional control of a "beam". Equally, the surface could be switched between a near-field communications state, in which a single opening is made transparent, and a far-field communications state, in which multiple openings are made transparent. As discussed already above, the number of effective openings determines the distance from the surface that an antenna must be placed to enable successful communication through the surface.

The bias circuit may comprise two or more layers of conductors.

This type of bias circuit can conveniently enable independent control over a plurality of control elements corresponding to two or more groups of openings (or portions of openings). For example, a first layer of conductors could be used to control all openings (or portions) corresponding to one polarisation, while a second layer of conductors is used to control the openings for another polarisation. This can enable a simple and easily fabricated pattern of conductors biasing the control elements. In turn, this can facilitate straightforward repetition to create a regular pattern with multiple openings. The separation between the two layers can be accomplished by various means, such as (for example) dielectric bridges at the intersections of conductors of the different layers. As an alternative to dielectric bridges, a complete additional layer of dielectric may be provided.

Two of the layers of conductors of the biasing circuit may be at opposing sides of the conductive sheet.

This is one alternative for providing two layers of conductors. Each layer of biasing-circuit conductors may be separated from the conductive sheet by a separate dielectric, these dielectric layers being provided on opposing sides of the conductive sheet. By separating the layers of the biasing circuit, each can be designed independently. This construction can further enhance design freedom. It may mean—for example—that dielectric bridges can be eliminated, or that more advanced biasing circuits can be fabricated easily.

The electrical control element may comprise at least one of: a PIN diode; varactor diode; and a MEMS switch.

A variety of active or variable control elements can be used to tune the frequency selective surface. Diodes, in general, are an advantageous alternative, since they provide a simple electrical switch, controlled by the DC voltage bias applied to the first and second conductors. Varactor diodes or varicaps provide a voltage controlled capacitance across the opening. Micro-electromechanical systems (MEMS) can provide another switching means.

According to another aspect of the invention there is provided a shield for selectively permitting or denying access by an RFID reader to an RFID tag, comprising the electronically tuneable surface described above.

Radio Frequency Identification (RFID) is one example of an application where it may be necessary or advantageous to communicate information (for example, information about a tagged object) selectively. For example, a tuneable surface can selectively enable an RFID reader to acquire information from objects with RFID transponder tags when the objects are being shipped in electrically conducting containers such as railroad freight cars and airline cargo containers. In one state, the RF band used by the RFID system is blocked by the tuneable surface; in another state, the surface is transparent to the RFID signals. Such selective access can enhance security and hinder tampering. It effectively transforms conventional RFID tags into a conditional-access technology.

According to a further aspect of the invention there is provided a system comprising an RF transmitter and an RF receiver, separated by an electronically tuneable surface as described above.

The invention will now be described by way of example with reference to the accompanying drawings, in which:

FIG. 1B illustrates an embodiment comprising two antennae separated by an RF shield when diodes across the slots are switched on;

Figure 1A:
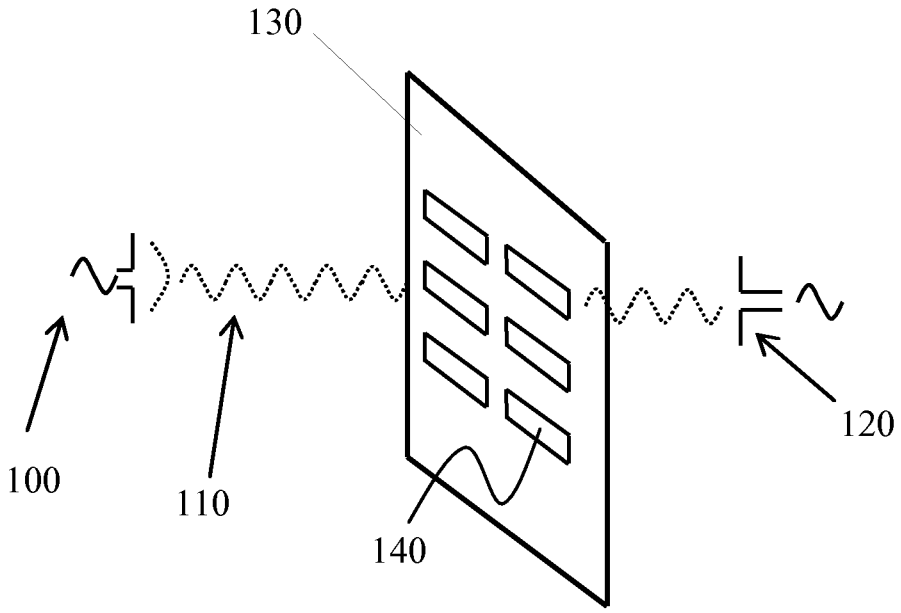
FIG. 1A shows an arrangement of two antennae communicating with one another through slots in an RF shield.

It should be noted that these figures are diagrammatic and not drawn to scale. Relative dimensions and proportions of parts of these figures may have been shown exaggerated or reduced in size, for the sake of clarity and convenience in the drawings.

The present inventors have recognised that certain types of pattern in a conductive sheet are more appropriate for use in active frequency selective surfaces. In particular, they have recognised that a contiguous conductive sheet with fully enclosed openings is advantageous, despite being difficult to bias using known methods. (Such a pattern is to be distinguished from, for example, a pattern of isolated conductive patches interspersed by gaps).

Furthermore, the inventors have devised a way to provide a biasing circuit for such contiguous conductive patterns, which overcomes the inherent difficulty of providing biasing for active elements. This difficulty arises because all points in a contiguous conductive area are implicitly at the same electrical potential (that is, voltage). This means that, in order to control active elements which selectively short-circuit openings in the (contiguous) pattern, it would be necessary to provide a separate biasing circuit, which is nonetheless electrically connected to the active elements where they bridge the openings.

The present inventors have recognised that capacitive coupling can be exploited to advantage to solve these problems and have devised an alternative biasing arrangement. In such an arrangement, the active elements are electrically isolated from the conductive sheet, but are connected to conductors which are part of the biasing circuit. These conductors then fulfil a dual role: they provide capacitive coupling to the conductive sheet, and at the same time can provide the bias voltages for the active elements.

Embodiments of the invention are able to control electromagnetic transmission in a predetermined frequency band by using advantageous design configurations for biasing PIN diodes in frequency selective slots. It is also possible to control polarisation of the frequency selective surface and set individual openings or regions within the frequency selective surface to be opaque. The biasing arrangements can be applied to most shapes of opening employed in frequency selective structures, including the Jerusalem cross. The following description will concentrate on openings formed of simple "slots", of various shapes. In this context, a slot is an elongate opening with substantially parallel slides. Of course, the invention is also equally applicable to other openings.

Figure 1B:
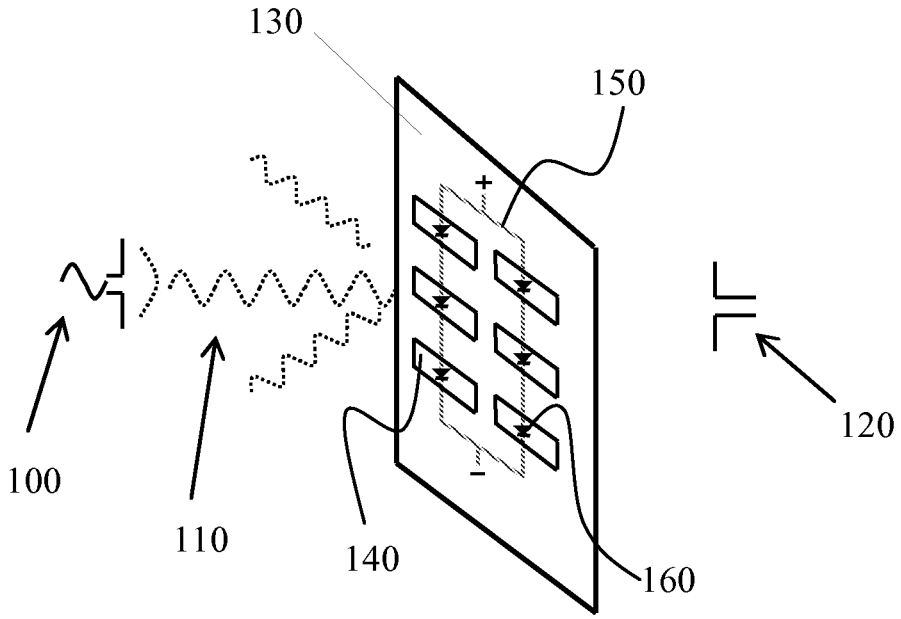
Figure 1C:
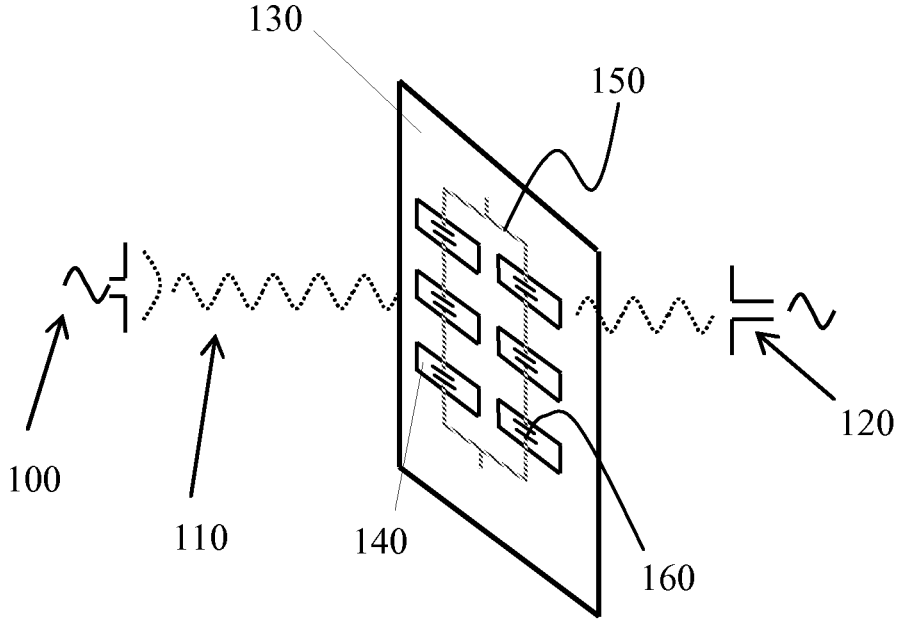
FIG. 1C illustrates the embodiment of FIG. 1B with the two antennae communicating with one another through the slots when the diodes are switched off.

As shown in FIG. 1A, frequency selective slot 140 arrays in a conductive sheet 130 can allow transmission 110 between two radiators 100 and 120 at a specific frequency band. In one embodiment, the conductive sheet is implemented as a sheet or layer of metal, providing a metallic "RF shield". A circuit 150 containing PIN diodes 160 can be implemented at one side of the shield, separated from it by a relatively thin dielectric layer. When the circuit is activated by an external DC source as shown in FIG. 1B, the RF shield becomes opaque at a predetermined resonant frequency. When the DC signal is not applied to the diodes, the capacitance of the diodes reduces the resonant frequency of the frequency selective slots. This state is shown in FIG. 1C. An arrangement of this kind is useful in many applications. The metal shield could be part of a piece of electronic equipment, a shipping container or even a shield implemented in a partition wall. The metal containing the frequency selective surface could also be part of a radome of an antenna.

Figure 2:
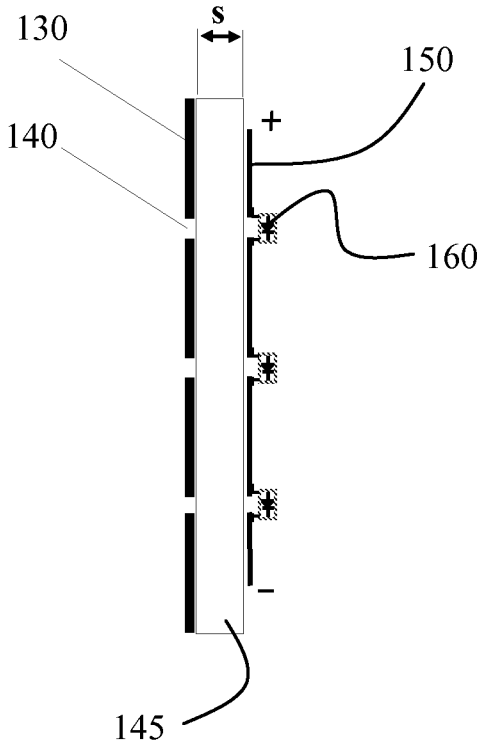
FIG. 2 is an example cross-section of the surface in the embodiment of FIGS. 1B and 1C.

FIG. 2 shows the side view of the RF shield 130 with frequency selective slots 140 and a layer of dielectric 145 of thickness s separating the slotted shield 130 from the biasing circuitry containing the PIN diodes 160. The thickness s should be relatively small compared with the wavelength for the switching technology to operate properly.

Figure 3:
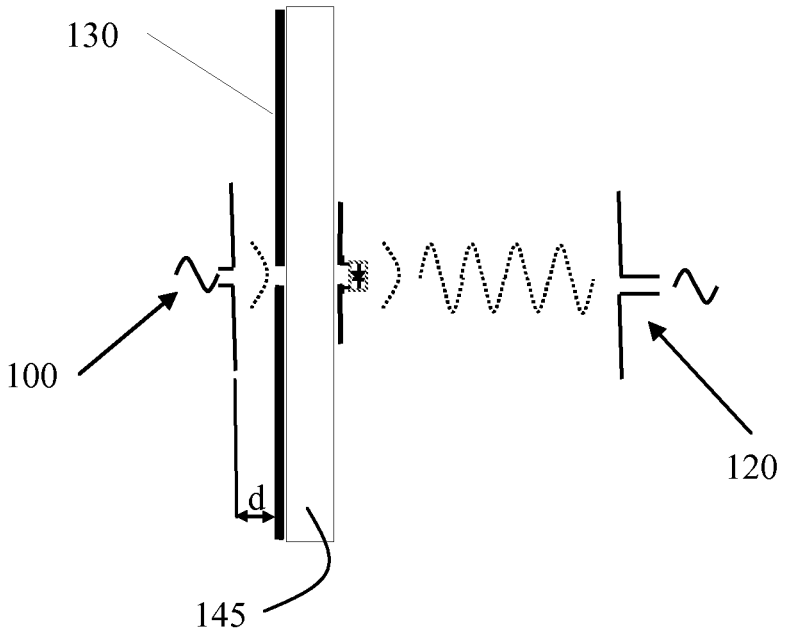
FIG. 3 illustrates the operation of a single slot when its diode is switched off.

For a single slot, as shown in FIG. 3, the transmitter 100 needs to be placed at a distance d from the slot in order to couple sufficient energy with the slot to make it resonate and transmit to the antenna 120 on the other side of the shield. The distance to the slot d is typically relatively small so that this can be considered as a near-field coupling—as opposed to far-field communication, which is the more usual mode for arrays of frequency selective slots. The use of a directional antenna can increase the maximum distance d. Diodes and biasing circuitry on the dielectric layer on one surface of the conductive sheet, around the slot, can switch on and off the transmission of electromagnetic waves. This arrangement is particularly convenient for secure systems—for example, where sensitive data can be stored in an electronic system, room or container, electrically shielded with a single slot. Access to data will only be possible when the transmitter couples to the slot and the diodes are de-activated/activated appropriately. In addition, relative shapes of the slot and antenna and their relative position can increase security in the case of a singly-polarised slot/antenna, since these must match to ensure effective communication. Alternatively, access to data can also occur when the receiver is close to the slot, the transmitter at greater distance (and the diodes correctly activated/de-activated).

Figure 4:
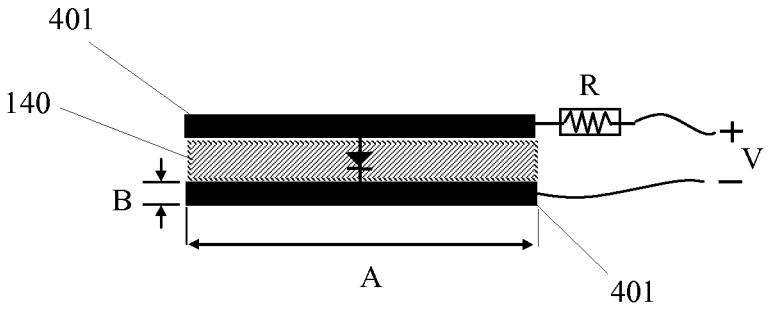
FIG. 4 depicts the biasing layer and circuit for a single slot with a single switching diode.

FIG. 4 shows a plan view of the geometry of the biasing circuit at the back of a single slot in an RF shield. First and second metallic patches 401 at the back of the slot and disposed either side of it operate as part of the circuit to activate the PIN diode. The circuitry exploits capacitive RF coupling of the biasing patches 401 with the conductive sheet 130 around the slot 140. The dimensions A and B of the patches should be long enough for the RF signal to capacitively couple with the regions of the conductive sheet 130 at either side of the slot. Accordingly, thicker dielectric material 145 will require relatively larger patches 401 than thin dielectric substrates. Although in this embodiment the metallic patches 401 are rectangular and parallel, it is to be understood that the conductors could be of any shape but able to place a diode in a direction that short the slot at any point along its length. Several diodes could also be place in a serial or parallel configuration so as to cut the length of the slot in several locations. The presence of a diode decreases the operating frequency of the slot in its off state, as it adds an extra reactive component in the middle o the aperture.

Figure 5:
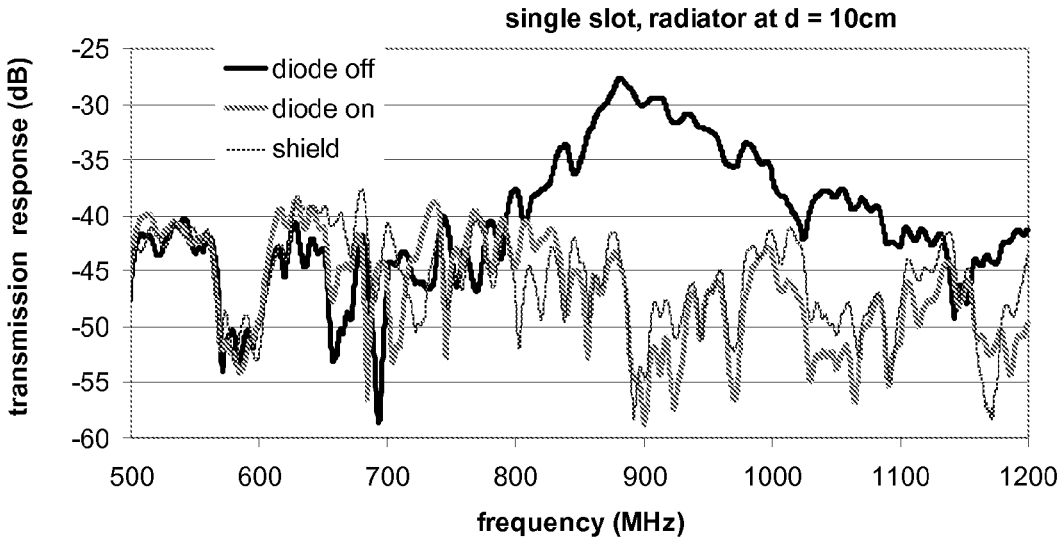
FIG. 5 is a transmission response of a single dipole slot operating in the 900 MHz band.

FIG. 5 shows a measured transmission response for an active single dipole slot of the kind shown in FIG. 4. This example is designed to operate at the 900 MHz band when a dipole antenna is placed (as in FIG. 3) at a distance of 10 cm from the RF shield. As can be seen from FIG. 5, isolation between the diode on and off states of approximately 15 dB can be found at the 869 MHz RFID band. The thin black plotted line shows the transmission response of a continuous shield (that is, the equivalent conductive sheet with no openings). As can be seen, this response compares favourably with the transmission response of the single-slot embodiment, when the diodes are switched on (thick grey line). When the diodes are off (thick black line) the transmission response is increased significantly in the desired pass-band. For the results shown in FIG. 5, the FSS was made by etching a slot on a thin copper layer attached to a dielectric substrate of thickness s=0.045 mm. The measurements were carried out with a broadband biconical antenna 10 cm from the slot and a receiver at 1.5 m from an absorbing panel of approximately 1.60×1.9 m containing the active slot in a centre position. The residual transmission observed in the case of the continuous shield and in the diode-off state was caused by leakage around the absorbing panel used in the experiment. The level of isolation would be higher in the case of a slot aperture in a completely shielded room or in a metallic container, with the receiving antenna inside the shielded enclosure.

Although not shown in the transmission response of FIG. 5, the slot will resonate at around twice the resonant frequency of its original geometry when the diode is in the on state and located at centre position of the slot. To increase the residual resonant frequency, the circuit in FIG. 6 can be employed. This uses multiple diodes bridging the slot, distributed at intervals along its length. The diodes are connected in series so that they are switched concurrently by a single supply voltage. This can be achieved by choosing the polarity of the diodes so that consecutive diodes bridge the slot in alternating "directions", connected in a "head-to-tail" fashion.

Figure 7:
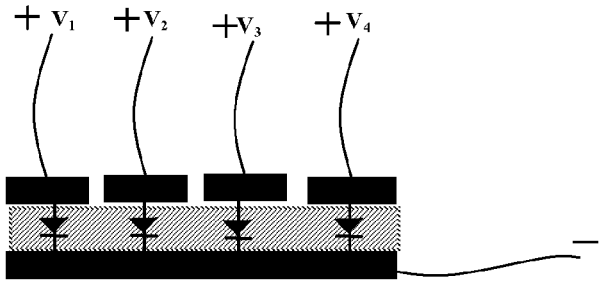
FIG. 7 depicts a biasing-circuit geometry with multiple diodes having independent applied voltages.

Using the circuit in FIG. 7, it is possible to vary the resonant frequency of the slot with greater resolution. Different combinations of the states of the four diodes can be used to create reconfigurable slots with differently tailored responses. This is achieved by controlling the diodes independently—that is, each diode can be switched on and off by the voltages V1, V2, V3 and V4, without affecting the others.

Figure 6:
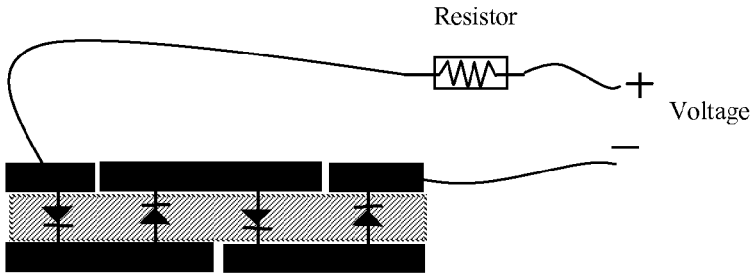
FIG. 6 depicts a biasing-circuit geometry for a single slot with four diodes.

In a further embodiment of the invention, it is also possible to vary the resonant frequency of the slot by replacing the diodes of FIG. 6 (or single diode of FIG. 4) with a variable capacitance, such as a varactor diode. The biasing current in these diodes (or single diode, respectively) will then determine the resonant frequency.

Figure 8A:
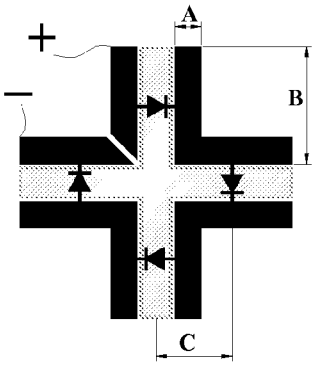
FIG. 8A depicts a biasing circuit geometry design for a single cross-shaped slot.
Figure 8B:
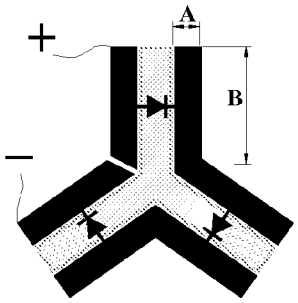
FIG. 8B depicts a biasing circuit geometry design for a single tripole slot.

FIG. 8A shows a circuit geometry that can be used with a dual-polarised cross-shaped slot. FIG. 8B shows a similar circuit for the case of a tripole; and FIG. 8C for a square loop slot. The distance C from the centre of the cross to the diode will determine the residual resonant frequency when the diodes are switched on. In each of these configurations, the diodes bridging the various slots are placed in series, by means of the layout of the biasing circuit—in particular, by the way the patches are interconnected. For these configurations, all the polarisations are switched jointly, by forward biasing or reverse biasing all the diodes together.

In FIGS. 8A and 8B, the series connection is achieved by arranging the diodes bridging each arm (of the cross and tripole, respectively) in a consistent clockwise or anti-clockwise sense. The anode of each diode can then be connected to the cathode of the neighbouring diode in the series, by electrically connecting adjacent metallic patches of each arm.

Figure 8C:
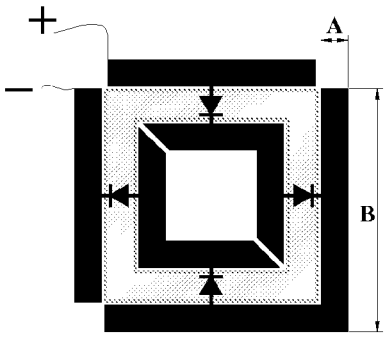
FIG. 8C depicts a biasing circuit geometry design for a single square loop slot.

In FIG. 8C, for the square loop, the series connection is achieved by alternating the polarity of consecutive diodes with respect to the slot: the anode of the first diode 801 is connected to a metallic patch 810 outside the loop, and its cathode is connected to a patch 811 inside the loop. This patch 811 is contiguous along two sides of the square (inside the loop) and the anode of the second diode 802 is connected to it, bridging the second side of the loop to its cathode, which contacts a third patch of conductor 812 outside the loop. This alternating pattern continues for the remaining third and fourth diodes.

Although the conductors (that is, patches) in FIGS. 8A, 8B and 8C are represented as straight lines, parallel to the slots, it should be understood that the technology also functions with conductors of different shapes. In addition, the diodes can be in different positions and orientations and still maintain the principle of capacitive coupling biasing the slots to switch them on and off.

Figure 9A:
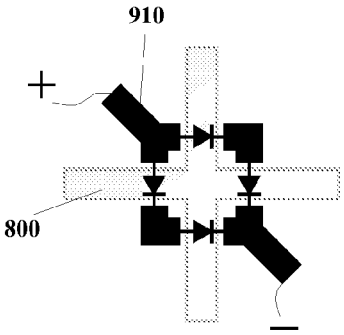
FIG. 9A depicts a biasing-circuit geometry for a single cross slot.

FIG. 9A shows another example embodiment, for switching a cross slot. Here, the diodes bridging each arm of the cross are arranged in two pairs in two parallel branches of the biasing circuit, so that each pair is in series.

Figure 9B:
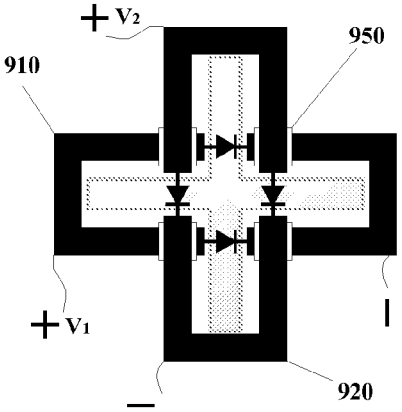
FIG. 9B depicts another biasing-circuit geometry for a single cross slot with polarisation control.

In FIG. 9B, dielectric bridges 950 have been fabricated, to isolate the biasing 920 for the vertical polarisation from the biasing circuit 910 for the horizontal polarisation. This configuration allows independent control of the two polarisations of the slot. Although small pieces of dielectric 950 are shown in FIG. 9B, the dielectric layer can substantially or completely cover the biasing layer of circuit 910.

Figure 9C:
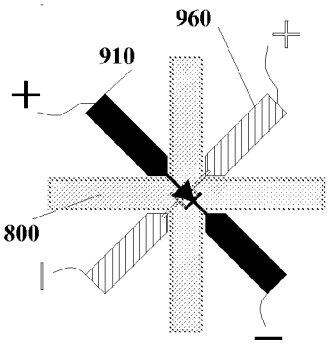
FIG. 9C depicts an alternative biasing-circuit geometry for a single cross slot using two layers of dielectric at opposing sides of the conductive sheet containing the slot.

A cross slot 800 can also be switched on and off by using two dielectric layers, one at each side of the RF shield, as shown in FIG. 9C. The conductor 910, shown in black, is the circuit of a biasing layer on a first dielectric layer; the other conductor 960, shown hatched, is the biasing circuit on a second dielectric layer on the opposing side of the RF shield. Multiple biasing layers separated by dielectric layers can be applied to control diodes or create slots that can be reconfigured. The design can be reconfigurable in terms of the transmission response, but the same principles can also be applied to polarisation control.

As will be apparent to one skilled in the art, different biasing circuits based on FIGS. 9A-C could be applied to a wide variety of shapes of slot, without departing from the scope of the invention.

As discussed earlier above, it is also advantageous to provide patterns having an array of openings in a conductive sheet—in particular for selectively controlling transmissions in a far-field propagation mode. For array patterns, the biasing circuit topology should allow for simple repetition, so that the array can be scaled easily (in terms of the number of openings).

Figure 10:
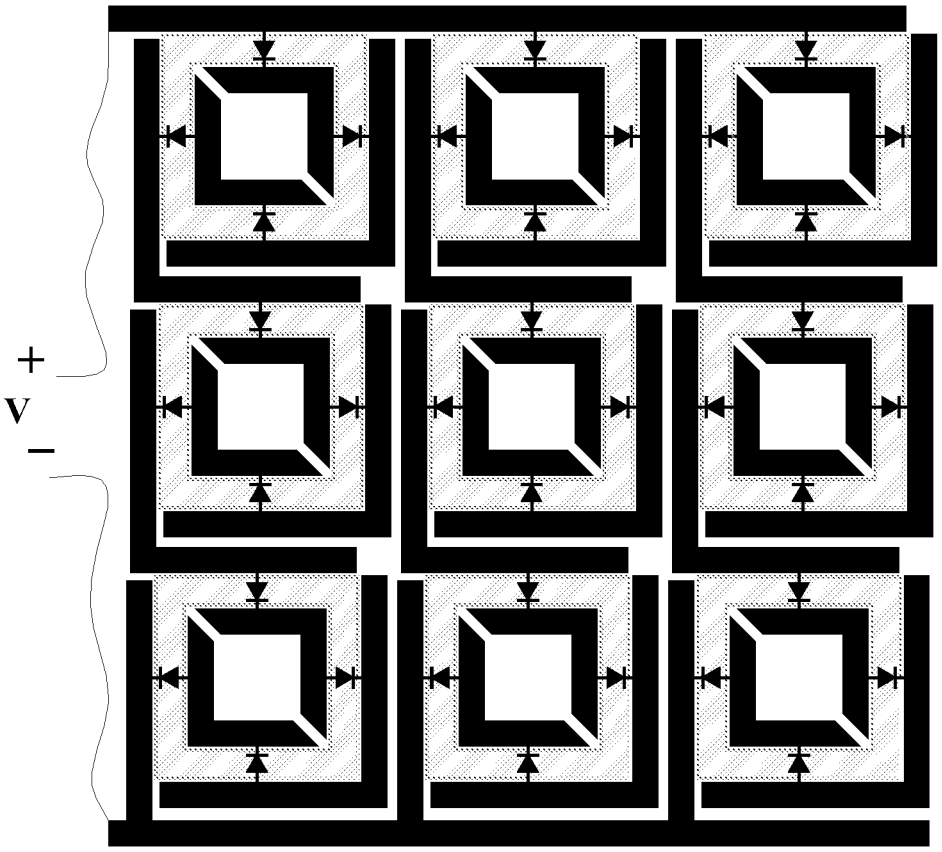
FIG. 10 depicts a biasing-circuit geometry for a 3×3 array of square loop slots.

One such embodiment, applying capacitive coupling biasing on an array of square-loop slots, is shown in FIG. 10. Although a 3×3 array is shown in FIG. 10, this can be extended to any array of any size. In addition, it is to be understood that the conductors can have different shapes and the diodes can be placed in different directions, orientations without departing from the scope of this technology. In the case of FIG. 10, the biasing circuit of FIG. 8C, for a single square slot, has been adapted to create an easily repeatable pattern. Each column of slots in the 3×3 array is connected in parallel with the other columns. Within a column, the rows are connected in series: the last diode crossing one slot is connected to the first diode of the next slot. With this topology, a single bias voltage can be applied through bus-bars at the top and bottom of the array.

Figure 11:
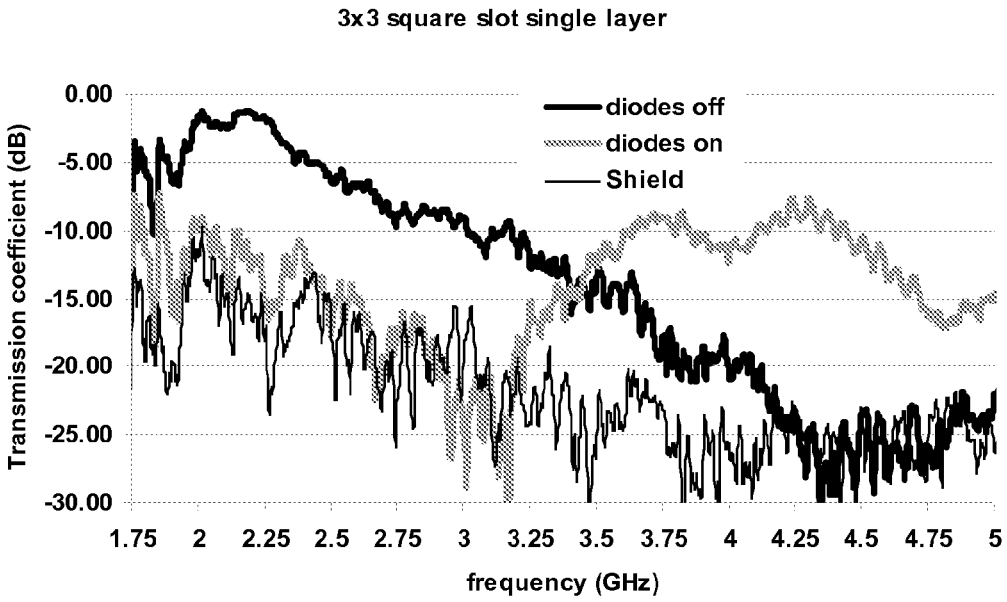
FIG. 11 is the transmission response of an array like that of FIG. 10, operating at 2.2 GHz.

FIG. 11 shows the transmission response of a 3×3 array of square loop slots of the kind shown in FIG. 10, operating at the 2 GHz band. The measurements were carried out in a plane wave chamber with the transmitter and the receiver at 1.5 m from an absorbing panel of approximately 1.60×1.9 m containing the active FSS in a centre position. Transmitted signal level changes of around 10 dB between the switched-on and switched-off states can be seen at 2.2 GHz. These results are intended merely to demonstrate the principles of the system, since relatively crude fabrication and measurement techniques were employed.

Figure 12:
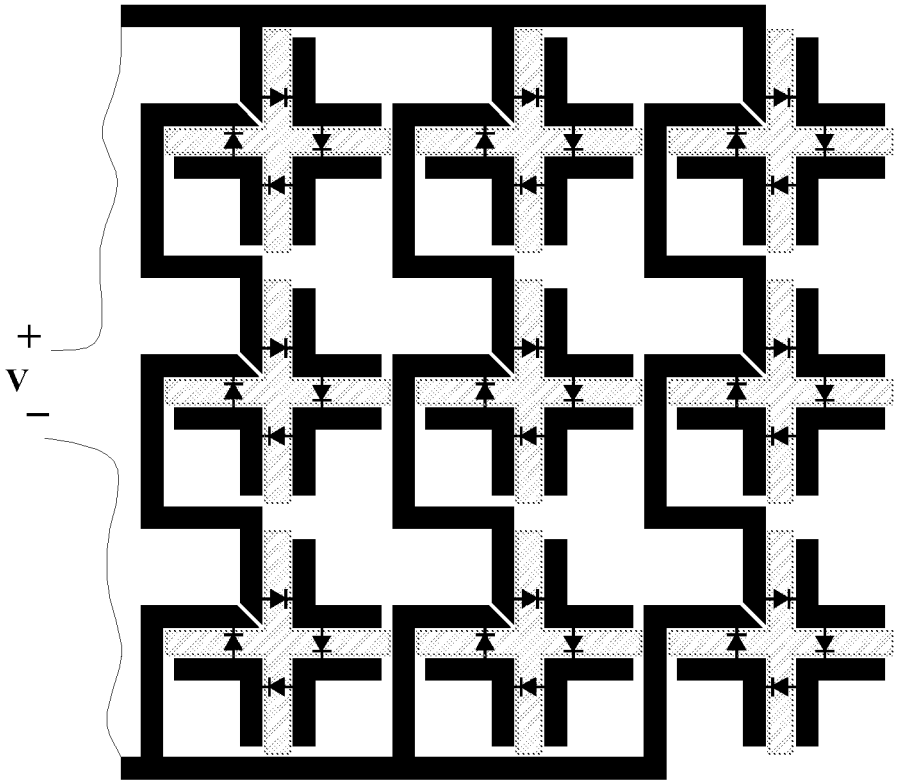
FIG. 12 depicts a biasing-circuit geometry for cross slot arrays.

FIG. 12 shows one of the many possible array structures using capacitive coupling biasing on an array of cross-shaped slots. This adapts the unit cell of FIG. 8A, along similar principles to those applied in FIG. 10. Other structures could be derived based on the unit cells of FIGS. 9A, 9B and 9C. Once again, the biasing conductors in FIG. 12 may have many different shapes, including—but not limited to—straight lines, crenulated lines and/or wavy/convoluted lines.

Embodiments of the invention can also be applied to two or more frequency selective surfaces in a cascade arrangement, in order to improve the roll-off rate. By stacking different layers of FSS, the transmission roll-off of the combined response becomes steeper (more selective). Independent control of each active FSS in a stack may also provide additional finer-grained control of the overall transmission characteristics.

Figure 13:
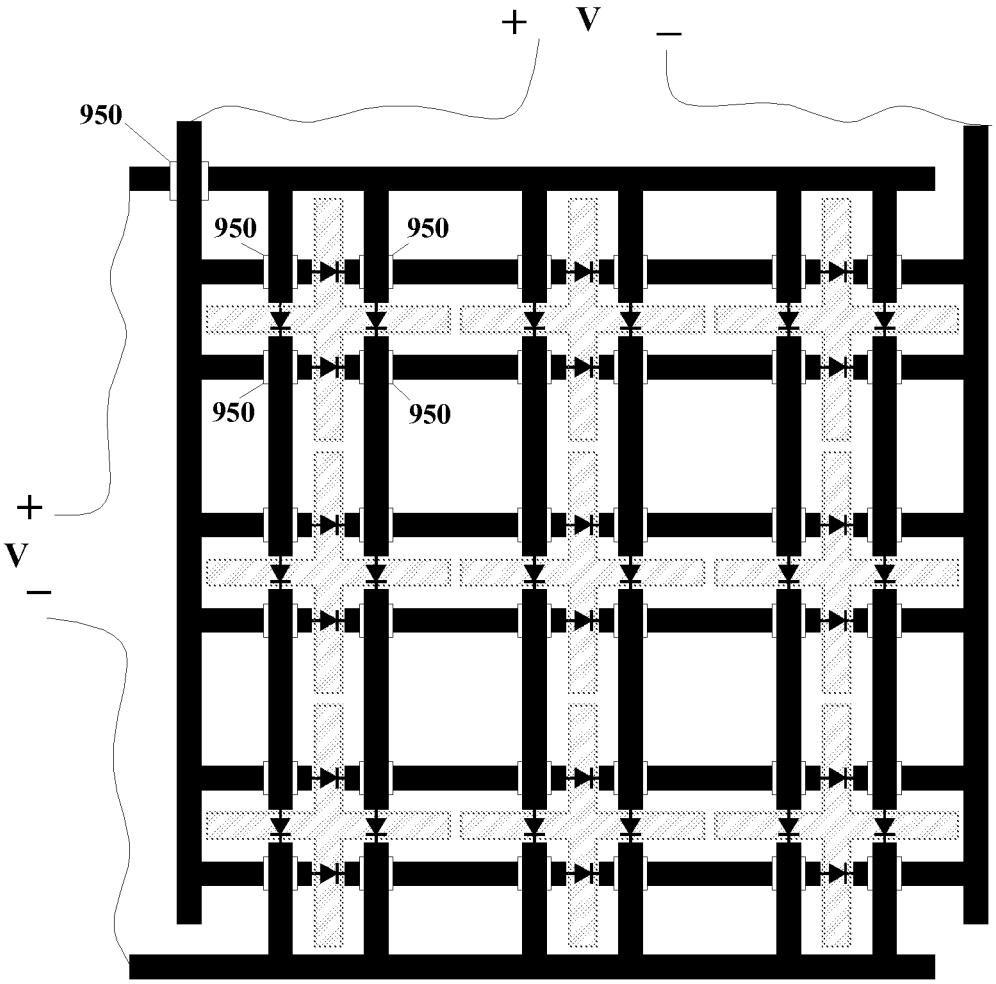
FIG. 13 depicts another biasing-circuit geometry for an array of cross slots, with polarisation control.

FIG. 13 presents the geometry of a biasing circuit that can independently control the polarisations of slot arrays using an embodiment of the invention. A basic circuit applied to one slot was described earlier with reference to FIG. 9B. Dielectric bridges 950 are used to isolate the biasing circuit for the horizontal and vertical polarisations. Alternatively, two complete dielectric layers could be used, one for each polarisation. The additional dielectric layer could be either on the top of the biasing circuit or on the opposite side of the conductive sheet containing the slots.

Multiple dielectric layers can also be employed to control different sections of a frequency selective surface made of multiple slots.

Figure 14:
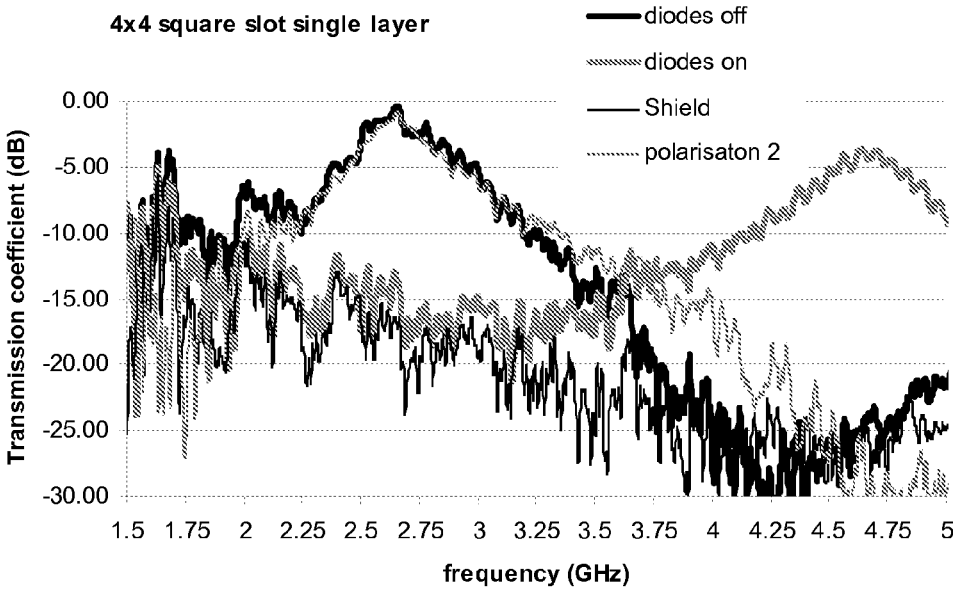
FIG. 14 is the transmission response of a cross-slot array like that of FIG. 13.

FIG. 14 shows a measured transmission response for a 4×4 cross slot array using a proportionally extended version of the circuit shown in FIG. 13. The isolation switches by about 15 dB at peak transmission at around 2.6 GHz. As can be seen from the figure, the second polarisation is transmitted even when the diodes for the first polarisation are switched off (thick grey line). This demonstrates that substantially independent control of the horizontal and vertical polarisations has been achieved in the frequency band of interest.

Figure 15:
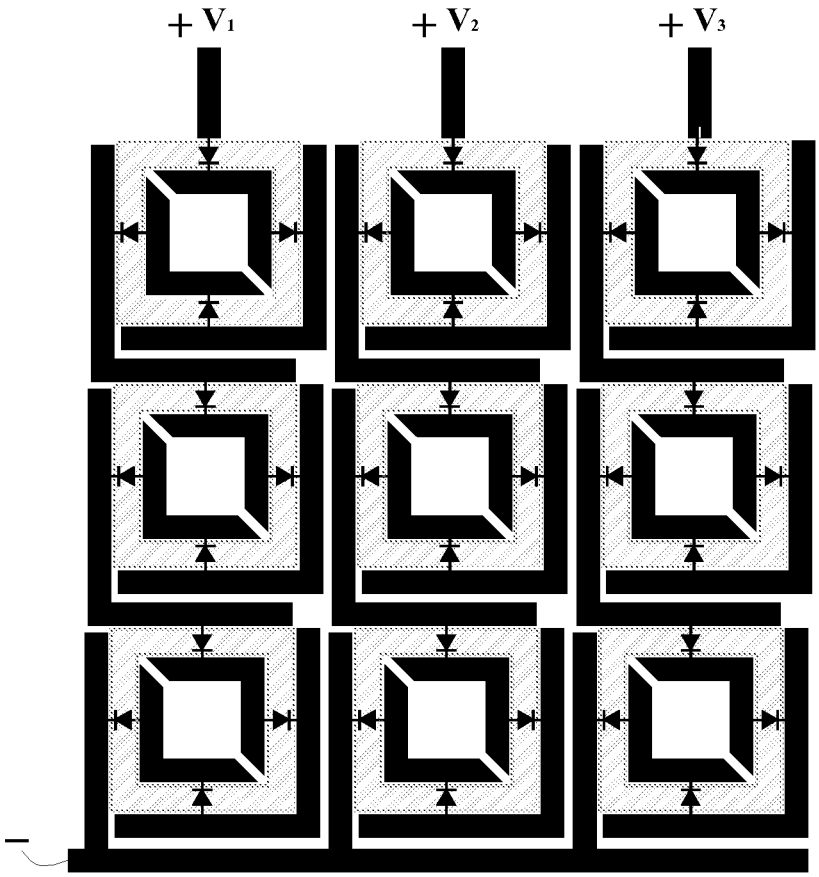
FIG. 15 depicts a biasing-circuit geometry for controlling the on/off states of different columns in an array of square-loop slots.

FIG. 15 shows a biasing circuit for square loop slots with independent switching control of each column. The topology is based on that of FIG. 10, but providing a separate positive bias voltage to the top of each column. This type of configuration can be particularly useful, for example, for beam shape control when the FSS is realised in a curved metallic shield. Such independent control could be applied for any type of frequency selective slot shape, according to any embodiment of the invention. For control with still greater resolution, individual slot elements (unit-cells) could be controlled through the use of multiple biasing layers with dielectric spacers between them.

Various other modifications will be apparent to those skilled in the art.

Active frequency selective surfaces according to embodiments of the invention may be particularly useful in secure applications where the diodes of the biasing layer are hidden from the user. By protecting the diodes from unwanted or unauthorised tampering, the safety and security of the system can potentially be increased considerably. This can be applied to many secure technologies, such as reading data from within a metallic enclosure; transmission between different part in an enclosure (for example, internally in washing machines, fridges, or cars); and to communications at greater distances outside the enclosure (such as secure communications in and out of buildings, ships, or ship containers).

Applications where it is necessary to communicate information about an object include: to acquire information from objects with RFID tags that are being shipped in electrically conductive containers (such as railroad freight cars or airline cargo containers); to take readings from commercial objects (for example, food, clothing, or shoes) that are stored in electrically conducting boxes or wrapped in a metallic-coated wrapping; and even to read data from objects that themselves comprise electrically conductive enclosures (from washing machines, to cars and ships, for example) and have parts that need to communicate to an antenna outside the object or to other parts in different sections of the enclosure (such as between motors, pumps, and electronic circuits).

Controlling electromagnetic propagation in buildings is another field where active frequency selective slots according to embodiments can advantageously be employed. Communications may be required between one office and another (or indeed to the exterior environment) at certain frequencies, at certain times, and yet be securely screened from other parts of the same building at other bands. This screening process has the potential not only to ease constraints on spectrum allocation but also to enable improved bit rates, reliability and security by controlling the interference environment.

Tuneable frequency selective slots can add security in all the above cases. In the case of objects shipped in containers or objects inside electrical conducting enclosures, for example, embodiments of the present invention would allow reading (communication) inside the object solely when the frequency selective slots are de-activated. Similarly, the electromagnetic architecture of buildings could be re-configured to allow propagation in certain zones when required.

Embodiments according to the invention can allow flexible and simple circuit designs, providing versatility as well as the associated benefits of easy and inexpensive construction. This can allow the adoption of active FSS technology in applications where it would not otherwise have been economical to do so.

The invention claimed is:

1. An electronically tuneable surface, comprising:

a conductive sheet comprising at least one opening; and a biasing circuit comprising:

first and second conductors, separated from the conductive sheet by a dielectric, and arranged at mutually opposing sides of the opening such that each conductor is capacitively coupled to the conductive sheet at the respective side of the opening, with a gap defined between the conductors corresponding to the opening; and an electrical control element bridging the gap, connected to the first and second conductors, wherein when the electrical control element is in a first state, the electronically tuneable surface has a first frequency transmission characteristic with respect to incident electromagnetic radiation, and when the electrical control element is in a second state, the electronically tuneable surface has a second frequency transmission characteristic, different from the first frequency transmission characteristic.

2. The surface of claim 1, wherein the first and second conductors are electrically isolated from the conductive sheet.

3. The surface of claim 1, wherein the state of the electrical control element is controlled by a bias voltage applied between the first and second conductors.

4. The surface of claim 1, wherein the biasing circuit comprises a plurality of electrical control elements bridging the gap, distributed along a length of the opening.

5. The surface of claim 4 wherein elements among the plurality of elements are independently controllable, so as to provide more than two states, each having a different frequency transmission characteristic.

6. The surface of claim 1, wherein the opening comprises an elongate portion in an orientation corresponding to a predetermined electromagnetic polarisation.

7. The surface of claim 6, wherein the opening comprises elongate portions in at least two linearly independent orientations, corresponding to predetermined different electromagnetic polarisations.

8. The surface of claim 7, wherein the portions of the gap corresponding to the at least two elongate portions of the opening are each bridged by a different electrical control element, these control elements being independently controllable.

9. The surface of claim 1, wherein the conductive sheet comprises a plurality of openings with associated biasing circuits.

10. The surface of claim 9, wherein electrical control elements of the biasing circuits for the plurality of openings are independently controllable.

11. The surface of claim 1, wherein the bias circuit comprises two or more layers of conductors.

12. The surface of claim 11, wherein two of the layers of conductors of the biasing circuit are at opposing sides of the conductive sheet.

13. The surface of claim 1, wherein the electrical control element comprises at least one of: a diode; varactor diode; and a MEMS switch.

14. A shield for selectively permitting or denying access by an RFID reader to an RFID tag, comprising the electronically tuneable surface of claim 1, wherein the first frequency transmission characteristic is such that the RF band used by the RFID reader is blocked by the tuneable surface; and the second frequency transmission characteristic is such that the surface is transparent to said RF band.

15. A system comprising an RF transmitter and an RF receiver, separated by an electronically tuneable surface according to claim 1.

* * * * *